US006865751B1

(12) United States Patent
Brasher

(10) Patent No.: US 6,865,751 B1
(45) Date of Patent: Mar. 15, 2005

(54) METHOD AND APPARATUS FOR TEMPORARILY AND DECORATIVELY ALTERING CLOTHING

(76) Inventor: Stephanie Brasher, 31482 Isle Vista, Laguna Niguel, CA (US) 92677

( * ) Notice: Subject to any disclaimer, the term of this patent is extended or adjusted under 35 U.S.C. 154(b) by 496 days.

(21) Appl. No.: 10/012,640

(22) Filed: Nov. 13, 2001

Related U.S. Application Data

(60) Provisional application No. 60/248,015, filed on Nov. 13, 2000.

(51) Int. Cl.[7] ..... A41D 27/10
(52) U.S. Cl. ..... 2/269
(58) Field of Search ..... 2/269, 232, 275, 2/274, 243.1, 244; 24/706, 707.05, 706.4, 707.4, 707.7, 708.6

(56) References Cited

U.S. PATENT DOCUMENTS

| | | | | | |
|---|---|---|---|---|---|
| 2,135,502 | A | | 11/1938 | Grigsby | |
| 2,497,305 | A | * | 2/1950 | Isaac et al. | 24/707.5 |
| 2,677,829 | A | | 5/1954 | Rothstein et al. | |
| 2,714,718 | A | | 8/1955 | Kramer | |
| 3,708,804 | A | | 1/1973 | Santos | |
| 3,766,566 | A | | 10/1973 | Tadokoro | |
| 4,149,275 | A | | 4/1979 | Sanchez | |
| 4,259,751 | A | * | 4/1981 | Drmaj | 2/269 |
| 4,602,389 | A | | 7/1986 | Brown | |
| 4,985,936 | A | * | 1/1991 | Jones | 2/269 |
| 5,006,393 | A | | 4/1991 | Isoe | |
| 5,153,944 | A | | 10/1992 | Teel | |
| 5,535,453 | A | | 7/1996 | Howard | |
| 5,606,780 | A | | 3/1997 | Kusano | |
| 5,787,511 | A | | 8/1998 | Garside | |

* cited by examiner

*Primary Examiner*—Tejash Patel
(74) *Attorney, Agent, or Firm*—Knobbe, Martens, Olson & Bear LLP

(57) ABSTRACT

A garment assembly includes a garment and a temporary hemming element. The garment comprises at least one fold wherein a portion of the garment is folded back upon itself. The temporary hemming element comprises a pin having a distal end extending from a second side of an outer portion. The outer portion is located on the garment so that the pin extends through the fold until it penetrates completely through the fold. An inner portion of the temporary hemming element receives the distal end of the pin of the outer portion to create a temporary decorative hem.

27 Claims, 6 Drawing Sheets

METHOD AND APPARATUS FOR TEMPORARILY AND DECORATIVELY ALTERING CLOTHING

RELATED APPLICATIONS

This application claims the benefit of U.S. Provisional No. 60/248,015, filed Nov. 13, 2000, the entirety of which is incorporated by reference.

BACKGROUND OF THE INVENTION

1. Field of the Invention

This application relates to temporarily and decoratively altering garments.

2. Description of the Related Art

Clothing is generally mass produced in a variety of sizes. Most casual clothing can be purchased in a range of sizes, and requires no alteration. On the other hand, some formal clothing is manufactured to be tailored when purchased to more accurately fit the purchaser. For example, slacks are made with very long legs so that purchasers of different heights having roughly the same waist size can purchase the slacks and have the leg length altered before wearing them. These alterations are effectively permanent because in order to have the slacks resized, the wearer must be return to the tailor, get remeasured, and if sufficient fabric is left (e.g., in a cuff), have the legs length altered.

Although generally acceptable, this system of permanent alteration does not very well address the different contexts in which a pair of slacks are worm. For example, different styles of shoes may be worn that effectively change the desired length of the slacks (i.e., high heels may require longer slack legs than flat shoes). In that case, the slack legs are either made for heels (and therefore are too long for flat shoes), or they are made for flat shoes (and therefore too short for heels). Custom tailoring each pair of slacks for each pair of shoes, while possible, is not very economical.

Furthermore, clothing for children quickly gets outgrown as the child gets older. Thus, hemming, altering, or folding up sleeves, pant legs, etc., of children's clothing is often used since much of the time clothing for children is purchased with "room to grow." Moreover, children often like to fold or alter clothing for decorative purposes. However, folding or other altering may not always be visually pleasing, nor does it always provide the capability of holding the clothing securely in place.

Various devices are used in conjunction with clothing. For example, it is known to attach a safety pin to a piece of clothing to hold it up. However, such pins are not very attractive and can be difficult to attach if multiple folds or thick fabric is involved. Also, tie tacks are known, which serve primarily to hold a tie close to the shirt of the wearer. Of course, a wide variety of buttons and pins have been attached to clothing for decoration or identification of the wearer, e.g., decorative pins or nametags.

SUMMARY OF THE INVENTION

In one embodiment, the present invention comprises a garment assembly that includes a garment and a temporary hemming element. The garment has an extending portion that comprises at least one fold wherein a portion of the garment is folded back upon itself. The temporary hemming element comprises an outer portion and an inner portion. The outer portion of the temporary hemming element comprises a first, decorative side, a second side opposite the first side, and a pin having a distal end extending from the second side. The outer portion is located on the garment so that the pin extends through the fold until it penetrates completely through the fold. The inner portion of the temporary hemming element comprises an aperture configured to temporarily secure the distal end of the pin of the outer portion. It will be appreciated that in another assembly the pin can extend from the inner portion to be temporarily secured to the outer portion.

In another embodiment, the present invention comprises a method for temporarily, decoratively altering a garment. A garment is provided. At least a portion of the garment is folded over upon itself to create a folded portion. The folded portion has an inward side facing the skin of the wearer and an outward side facing away from the skin of the wearer. At least one temporary hemming element is provided that comprises an outer portion and an inner portion. The outer portion comprises a first, decorative side, a second side opposite the first side, and a pin having a distal end. The pin extends from the second side. The inner portion comprises an aperture configured to temporarily secure the distal end of the pin of the outer portion. The distal end of the pin of the outer portion is pushed through the folded portion so that the distal end of the pin extends through the folded portion until it penetrates completely through the folded portion. The inner portion is attached to the outer portion so that the distal end of the pin of the outer portion extends through the aperture. This method is repeated for each of the at least one temporary hemming element.

In another embodiment, the present invention comprises a temporary hemming apparatus for altering the size of a garment having a folded-over portion. The temporary hemming apparatus comprises an outer portion configured to attach to an outer portion of the garment. The outer portion comprises a first, decorative side, and a second side opposite the first side configured to abut the folded-over portion of the garment. An inner portion comprises a first side configured to abut the folded-over portion of the garment, and a second side that is configured to reside proximate the wearer. The temporary hemming apparatus also comprises an elongate piercing member having a distal end. At least one of the inner portion and outer portion is configured to secure the distal end of the elongate piercing member.

These embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiments disclosed.

BRIEF DESCRIPTION OF THE DRAWINGS

Having thus summarized the general nature of the invention, certain preferred embodiments and modifications thereof will become apparent to those skilled in the art from the detailed description herein having reference to the figures that follow, of which.

DETAILED DESCRIPTION OF THE PREFERRED EMBODIMENTS

A garment assembly is disclosed wherein a garment is temporarily and decoratively hemmed, or altered. Many different types of garments can be temporarily and decoratively hemmed using the embodiments disclosed herein, e.g., a shirt (see FIG. 1A), or a pair of slacks or pants (see FIG. 1B). Different embodiments of the apparatus and methods disclosed herein also could be applied to a skirt, a dress, shorts, and socks. Other garments could also be altered by the embodiments described herein, as will be understood by one skilled in the art. As used herein, the term "garment" is a broad term and is used in its ordinary sense and is intended to include, without being limited to, clothing, clothing accessories, and a variety of household items, such as curtains, drapes, bed linens, slipcovers, and shower curtains. Each of these garments can be altered by the embodiments described herein. In addition, the embodiments disclosed herein could be used to secure two or more fabric objects together, such as securing comforters to duvet covers.

Figure 1A:
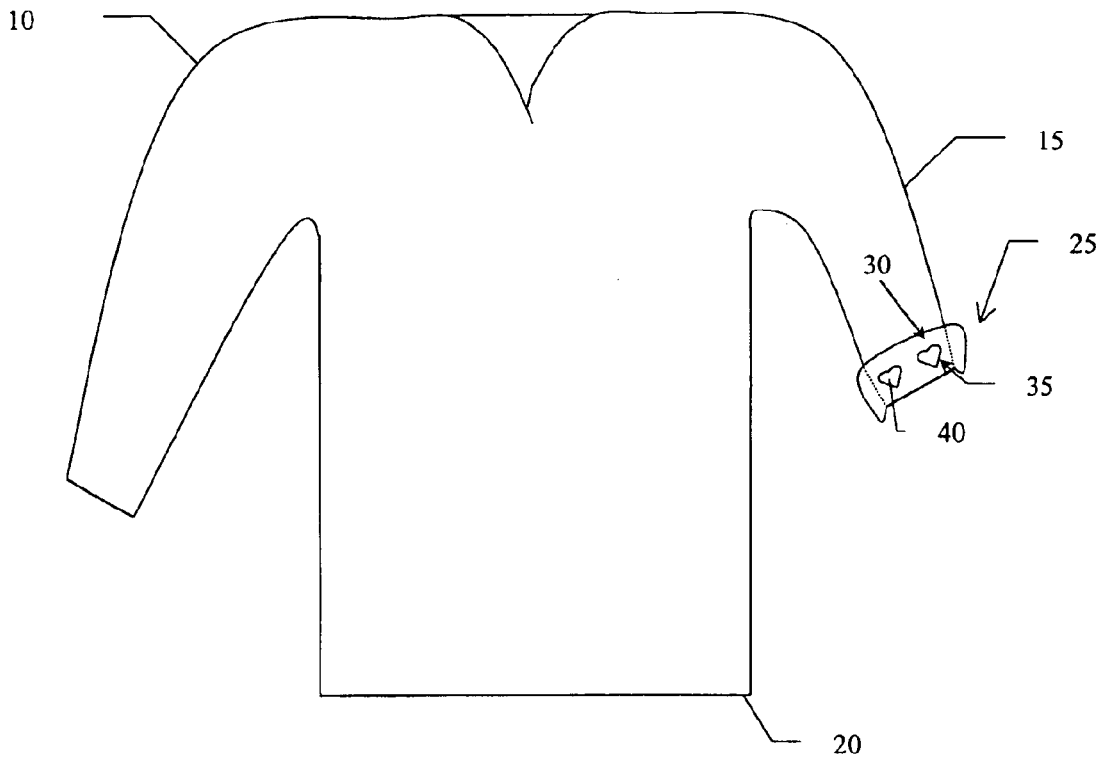
FIG. 1A is a pictorial representation of a garment assembly that includes a garment having at least one temporary hemming element applied thereto.

As shown in FIG. 1A, one embodiment includes a garment 10. As may be seen, the garment 10 of FIG. 1A is preferably an article of clothing, more preferably a shirt having an extending portion 15. As shown, the extending porting 15 is a sleeve of the garment 10. The extending portion 15 includes a fold, or a folded portion 25. The fold 25 is a portion of the garment 10 that is folded back upon itself at least once if not more. This causes at least one length of garment overlap. When the extending portion 15 of the garment 10 is formed with only one length of garment overlap, a relatively slight alteration of the garment length is achieved. While the length of garment overlap of the folded portion 25 is shown on the outside of the extending portion 15, one skilled in the art will recognize that the folded portion 25 can also be positioned on the inside of the garment, i.e., with the folded portion 25 facing the skin of the wearer.

The apparatus and method disclosed herein advantageously permit more than one length of overlap of the extending portion 15 of the garment 10. By increasing the number of lengths of overlap, the garment assembly may be more extensively and dramatically altered. This can enable the wearer of the garment to change a full-length sleeve to a three-quarter length sleeve, or even to a short sleeve.

As will be understood by one skilled in the art, a garment 10 may include more than one extending portion 15. For example, the garment 10 of FIG. 1A has another extending portion 20 that may also have a folded portion 25. Thus the shirt of FIG. 1A could be converted from a full length shirt to one that exposes a portion of the wearer's lower torso.

Figure 1B:
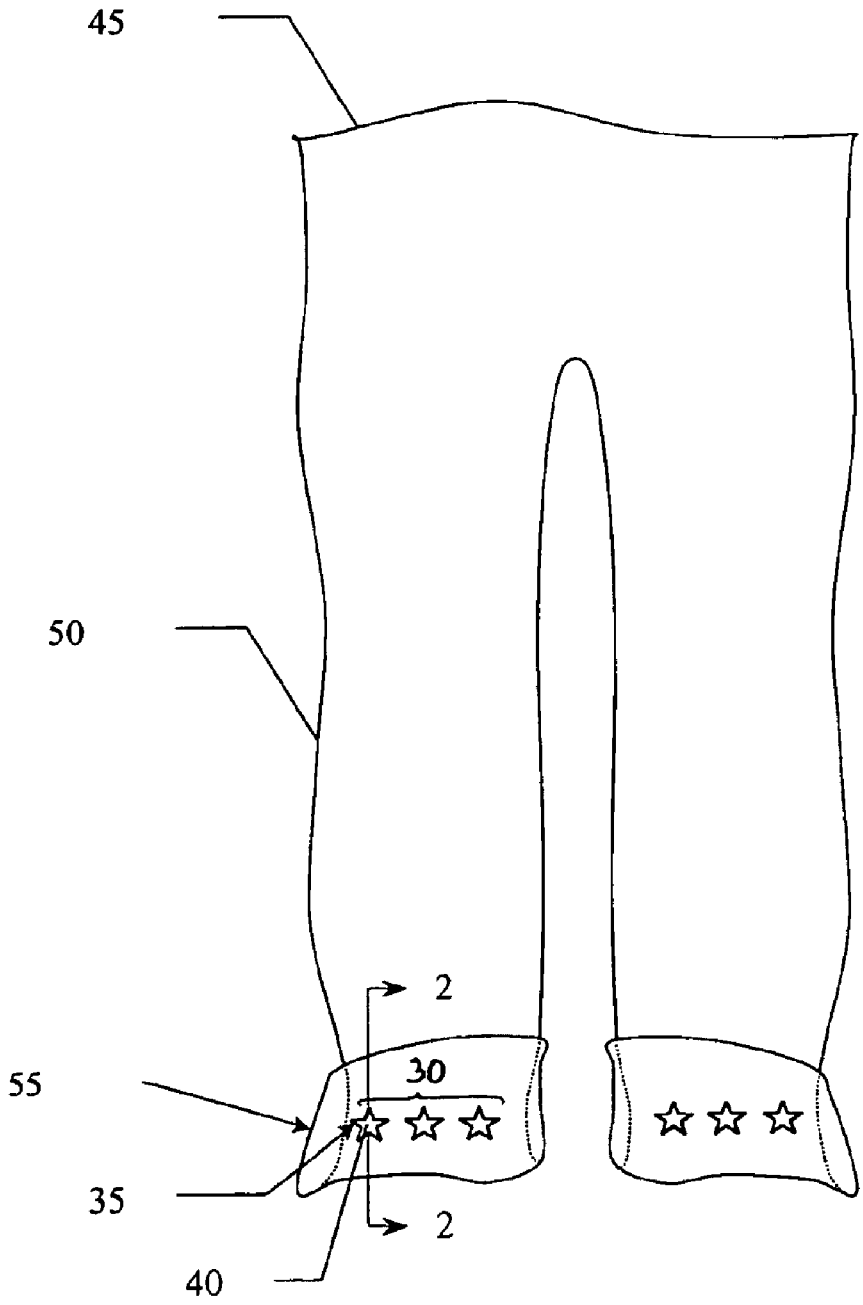
FIG. 1B is a pictorial representation of another garment assembly that also includes a garment having at least one temporary hemming element applied thereto.

The embodiment of FIG. 1A also shows that a temporary alteration of the garment 10 may be achieved using a plurality of temporary hemming elements 30 attached to the folded portion 25. In one embodiment, a set of twelve temporary hemming elements 30 is used. The elements 30 thereby secure the folded portion 25 in the folded configuration, and thus maintain the alteration as long as the elements 30 are affixed to the garment 10. With twelve elements 30, even the widest pant leg, straight skirt, or A-line skirt can be pleasingly altered. As shown in FIGS. 1A–1B, fewer than twelve elements 30 could be used. For some extending portions, a single temporary hemming element 30 may be used. A wearer may only require a single hemming element 30 if the extending portion is relatively small, such as a sleeve. Alternately, only a few elements 30 may be used if the wearer prefers that the extending portion assume an arcuate or other desired shape.

FIG. 1B shows another embodiment of the garment assembly disclosed herein. The garment 45 has an extending portion 50, which is a pant leg, and a folded portion 55. As in FIG. 1A, the temporary hemming elements 30 are attached to the folded portion 55. The attachment of the temporary hemming elements 30 to the garment 45 is shown in more detail by the cross section 2—2 of FIG. 1B and is discussed below in more detail in connection with FIG. 2.

The elements 30 preferably have an outer portion 35 with a first, decorative side 40. The decorative side might have a stylized cat's face that is white and that has pink ears. In addition, the decorative side 40 might have a heart (shown in FIG. 1A), a star (shown in FIG. 1B), or a diamond. The decorative side 40 could be configured with other decorative figures as well. The decorative side 40 might have a symbol representing affiliation with a group. For example, the decorative side 40 could have a junior high or high school mascot, team name or school symbol or name. Also, the side 40 could equally well be made with a college or professional team mascot, or a college organization's name or symbol. The decorative side 40 can pleasingly be made either to have a generally flat surface or to have a contoured surface. In the flat configuration, the decorative side 40 can be generally more subdued, as might be appropriate for a more formal setting. The contoured configuration of the decorative side 40 might better suit a stronger expression of the wearer's individuality.

Figure 3:
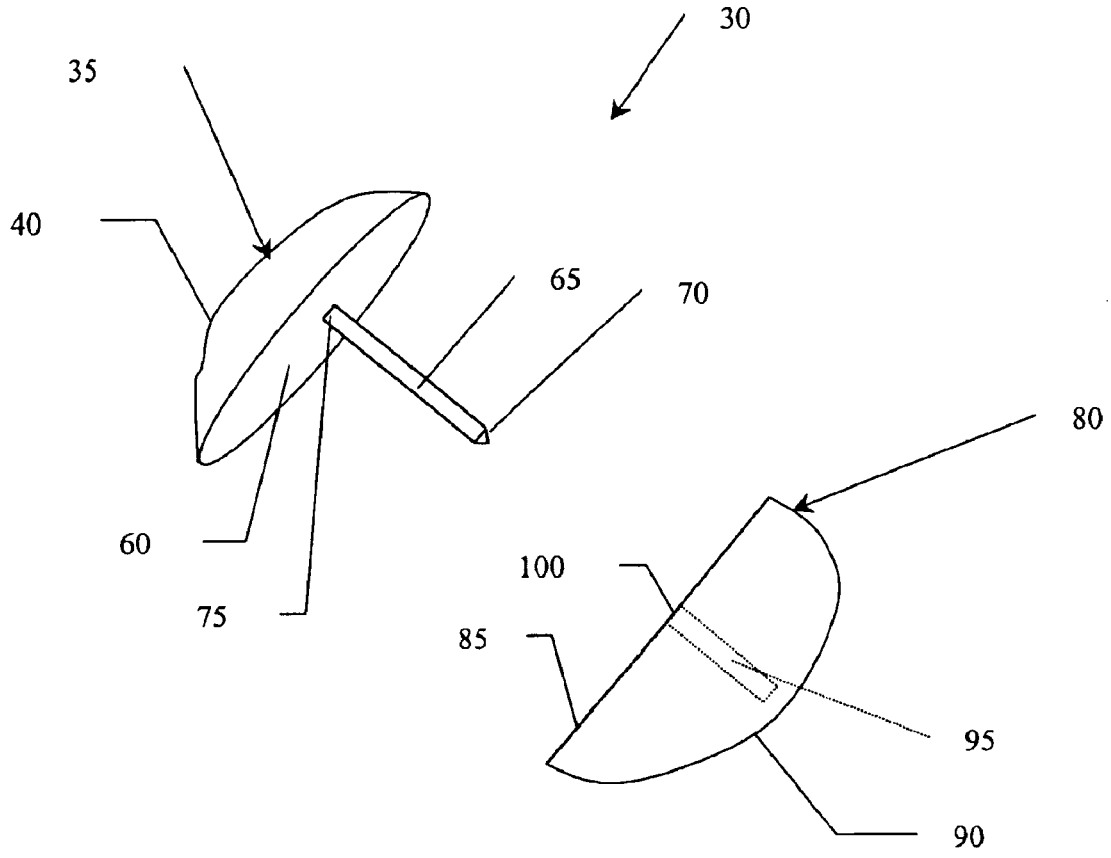
FIG. 3 is a perspective view of one embodiment of a temporary hemming element.

The outer portion 35 also has a second side 60 that is opposite the first side 40 (see FIG. 3). The outer portion has a pin 65 that has a distal end 70 and an end 75. The end 75 of the pin 65 is opposite the distal end 70 and is connected to the second side 60 of the outer portion 35. Of course, the pin 65 may be connected to the second side 60 of the outer portion 35 in many ways, as is known in the art. For example, the pin 65 and the outer portion 35 may be integrally made.

Figure 2:
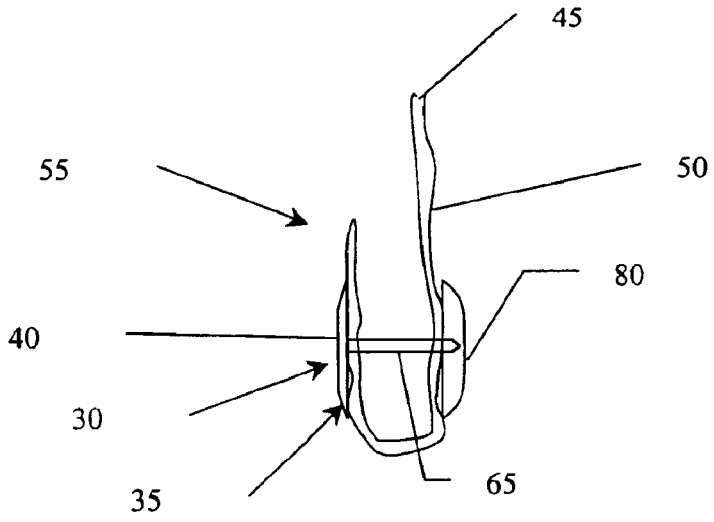
FIG. 2 is a cross-sectional view taken along the section plane 2—2 shown in FIG. 1B.

FIG. 2 shows one embodiment of the various components of one of the temporary hemming elements 30 and also shows an application of one of the elements 30 to the garment 45. As may be seen, the outer portion 35 is located on the garment 45 so that the pin 65 extends through the fold 55 until it penetrates completely through the fold 55. As shown in more detail in connection with FIG. 2, the element 30 extends through the folded portion 55, and is secured to it. The element 30 thereby maintains the folded portion 55 in the folded configuration, and thus maintains the alteration of the garment 45 as long as the element 30 is affixed to the garment 45. One advantage of the element 30 is that when the wearer wishes to remove the alteration of the garment 10 or 45 maintained thereby, the element 30 may simply be removed and the folded portion 25, 55 unfolded, returning the garment 10 or 45 to an unfolded configuration.

As may be seen from FIGS. 2 and 3, the element 30 further comprises an inner portion 80 that has an garment-facing side 85 and a wearer-facing side 90. The inner portion 80 has a bore 95 that extends from an aperture 100 in the garment-facing side 85. In one embodiment, the aperture 100 and the bore 95 may together secure the pin 50 so that the inner portion 80 and outer portion 35 remain connected while the garment 10 or 45 is temporarily altered. In another embodiment, the aperture 100 may alone secure the inner portion 80 to the outer portion 35 to maintain the temporary alteration of the garment 10 or 45. The inner portion 80 and the outer portion 35 are secured in one of a number of ways known in the art, including screw-in type and push-in type.

Although the temporary hemming element 30 has been described above as comprising the pin 65 attached to the outer portion 35 and received in the aperture 100 of the inner portion 80, it will be recognized by one skilled in the art that the invention can be practiced with the pin 65 mounted on the inner portion 80 and with the outer portion 35 having the aperture 100 to receive the pin 65. In addition, the temporary hemming element is not limited to being made with a pin, and other methods of attaching an inner portion to an outer portion through a fold of clothing or other material may also be used.

Figure 4:
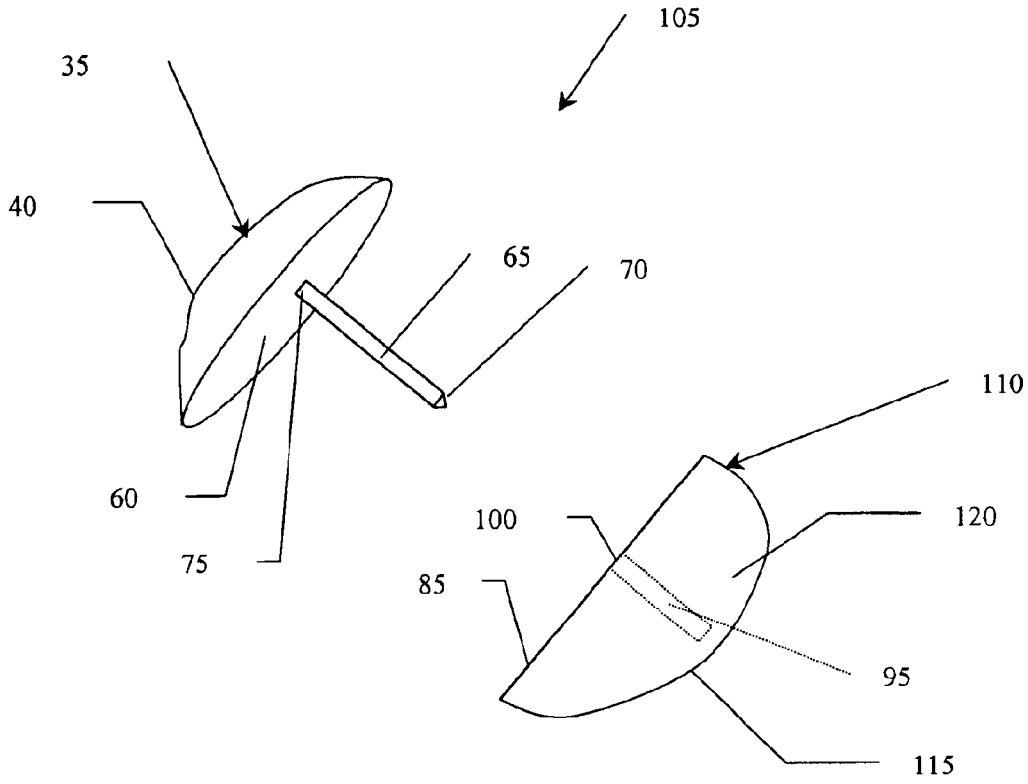
FIG. 4 is a perspective view of another embodiment of the temporary hemming element.

FIG. 4 shows another embodiment of the temporary hemming element 105. The element 105 is similar to the embodiment shown in FIGS. 1A–3. However, the inner portion 110 has a wearer-facing side 115 that has a compliant surface 120. The compliant surface is made of a material that does not irritate the skin in those applications where wearer-facing side 115 of the temporary hemming element 105 is positioned proximate the skin of the wearer. The compliant surface 120 may comprise an additional material applied to the wearer-facing side 115, such as felt or another soft cloth-like material. The wearer facing side could also be a more rigid material, but one that is selected to be non-irritating to the skin, such as Teflon. Alternately, the entire inner portion 110 could be made of a compliant material, such as plastic. In another variation, the compliant surface 120 may comprise a smooth surface advantageously configured to not snag underlying clothing. Such a material could be, for example, a plastic material, or a rubber material.

Figure 5:
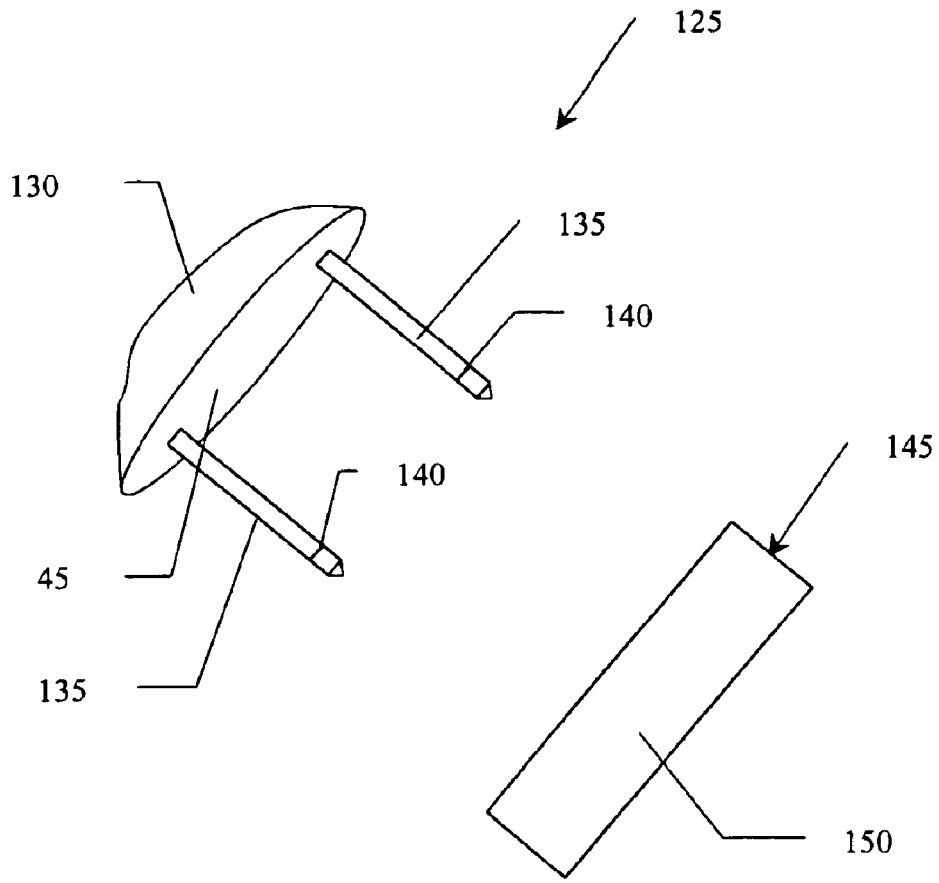
FIG. 5 is a perspective view of another embodiment of the temporary hemming element.
Figure 5A:
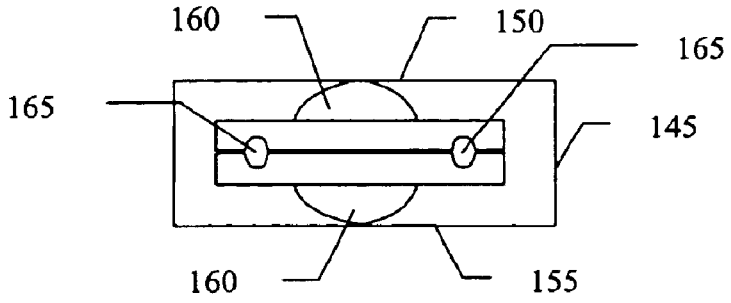
FIG. 5A is a top view of one embodiment of an inner portion, or bar, with internal structure to secure the outer portion of a temporary hemming element.

FIG. 5 shows another embodiment of a temporary hemming element 125. The element 125 is similar to the element 105 shown in FIG. 4. However, the outer portion 130 has more than one pin 135. This, it will be appreciated that hemming elements may be elongate in shape. Each of the pins 135 preferably has a groove 140 proximate the distal end. These pins may be secured by a bar 145 having internal structure that clasps the pins 135. As shown in FIG. 5A, the bar 145 comprises a first lateral edge 150 and a second lateral edge 155. The inside of the first and second lateral edges 150, 155 contact a corresponding lever 160. The lever 160 comprises at least two apertures 165. The pins 135 of the element 125 are secured by a wearer or user who presses against the opposite lateral sides 150, 155 of the bar 145. This causes the apertures 165 to open. Then the bar 145 and the pins 135 are positioned so that the pins 135 are within the apertures 165. The wearer or user then releases the opposite lateral sides 150, 155 so that the apertures 165 contract and secures the pins 135 at the grooves 140. This keeps non-symmetrically shaped outer portions 130 in their proper orientations. In another embodiment, the multi-pin arrangement shown in FIG. 5 can be secured by two separate pieces similar to the inner portion 80.

Figure 6:
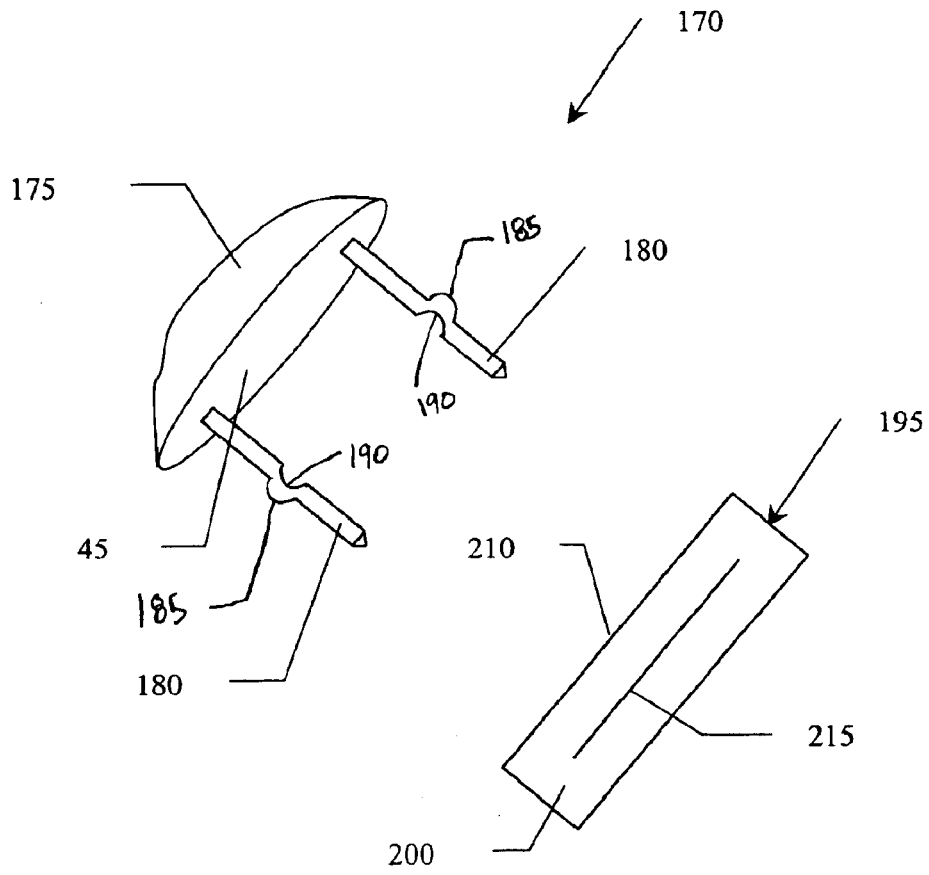
FIG. 6 is a perspective view of another embodiment of the temporary hemming element.
Figure 6A:
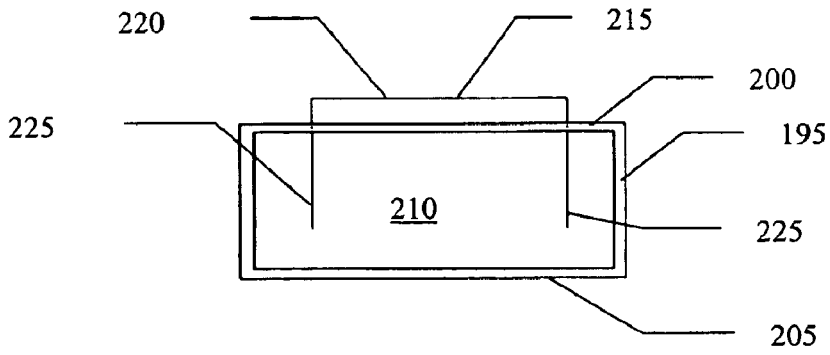
FIG. 6A is a top view of another embodiment of an inner portion, or bar, with internal structure to secure the outer portion of a temporary hemming element.

FIG. 6 shows another embodiment of a temporary hemming element 170. The element 170 is similar to the element 105 shown in FIG. 4. However, the outer portion 175 has more than one pin 180. Each of the pins 180 have a notched portion 185 with a latch receiving portion 190. The notched portion could be semicircular, as in FIG. 6. These pins 180 may be secured by a bar 195 having internal structure that clasps the pins 180. As shown in FIG. 6A, the bar 195 comprises a first lateral side 200, a second lateral side 205, a cavity 210, and a clasping device 215. The clasping device 215 comprises a manipulable bar 220 and a pair of elongate latches 225 that are slideable through the first lateral side 200 and the second lateral side 205. The pins 180 of the element 195 are secured by a wearer or user who locates the outer portion 175 and the inner portion, or bar 195, so that the pins 180 extend into the cavity 210. The wearer or user then slides the latches 225 of the clasping device 215 into the cavity 210 and into the latch receiving portion 190 of the notched portion 185 of the pin 180. The wearer or user then slides the clasping device 215 until the latches 225 extend through the second lateral side 205. Once located in the latch receiving portion 190 of the notched portion 185 of the pin 180, the clasping device 215 secures the outer portion 175 to the bar 195. This keeps non-symmetrically shaped outer portions 635 in their proper orientations.

The embodiments disclosed herein have several advantages. For example, the temporary hemming elements 30, 105, 125, 170 make it possible to maintain clothing length, e.g., the hem of pants, shirts, etc., at the correct length. As mentioned above, this can be particularly useful for children who are rapidly growing and for whom clothing is bought that is slightly larger than appropriate. This quick and temporary clothing adjustment is also particularly advantageous for people who wear a variety of shoes with their pants, for example, flat shoes or high heels.

Another advantage of the temporary hemming elements 30, 105, 125, 170 is that they provide a decorative feature for clothing that is flexible in its application. One way in which they are flexible is that the user can purchase one or more elements 30, 105, 125, 170 and use them as appropriate for more formal occasions or for casual occasions. The elements 30, 105, 125, 170 are also flexible in that they can be applied in other ways to clothing or household items. The elements could also be used to attach cuffs, lace, scarves, collars, hoods, decorative patches, nametags, etc., to clothing. In the home, the elements 30, 105, 125, 170 can be used to attach ribbons, embroidery, tassels, trim, and other decorative elements to furnishings, curtains, etc. The elements 30, 105, 125, 170 are also flexible in that they also can be used to fasten many items. For example, they can be used to fasten tiebacks to drapes and in lieu of or to replace buttons on clothing. Being decorative in nature, the elements 30, 105, 125, 170 can also be applied to various accessories to decorate them. For example, one or more of the elements could be applied to a purse, a belt, or a backpack to decorate them. The elements 30, 105, 125, 170 can also be used to decorate the home.

It will be appreciated that various methods may be used with the apparatus above. In particular, methods of temporarily and decoratively altering clothing can be practiced with the above apparatus. Also, decorative securement of one fabric object to another can be practiced.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A garment assembly comprising:

a garment having an extending portion comprising at least one fold wherein a portion of the garment is folded back upon itself;

a temporary hemming element comprising an outer portion, an inner portion, and a pin having a first end connected to one of the outer portion and inner portion and a distal end;

the outer portion comprising a first, decorative side, and a second side opposite the first side;

the temporary hemming element located on the garment so that the pin extends through the fold until it penetrates completely through the fold;

at least one of the inner portion and the outer portion configured to temporarily secure the distal end of the pin.

2. The garment assembly of claim 1, wherein the pin extends from the second side of the outer portion, and wherein at least one aperture is formed on the inner portion.

3. The garment assembly of claim 1 further comprising two pins that extend from the second side of the outer portion.

4. The garment assembly of claim 3 wherein the pins each have a notch, and the inner portion comprises a clasping device having an elongate latch corresponding to each of the pins and a manipulable bar.

5. The garment assembly of claim 3 wherein each of the pins have a groove, and the inner portion comprises a first lateral side, a second lateral side, a lever corresponding to each of the lateral sides, and an aperture corresponding to each of the pins, the lateral sides being flexible so that inward pressure on the lateral sides actuates the lever to move the apertures from an open configuration to a closed configuration.

6. The garment assembly of claim 1, wherein the inner portion further comprises a soft side configured to reside proximate the skin of the wearer of the garment without causing discomfort thereto.

7. The garment assembly of claim 1, wherein the inner portion further comprises a smooth side configured to not snag underlying clothing.

8. The garment assembly of claim 1, wherein the garment is a shirt.

9. The garment assembly of claim 8, wherein the extending portion is a sleeve of the shirt.

10. The garment assembly of claim 8, wherein the extending portion is a bottom edge of the shirt.

11. The garment assembly of claim 1, wherein the garment is a pair of pants.

12. The garment assembly of claim 1, wherein the garment is a skirt.

13. The garment assembly of claim 1, wherein the garment is a dress.

14. A method for temporarily decoratively altering a garment comprising:

(a) providing a garment;

(b) folding at least a portion of the fabric over upon itself to create a folded portion, the folded portion having an inward side facing the skin of the wearer and an outward side facing away from the skin of the wearer;

(c) providing at least one temporary hemming element comprising an outer portion, an inner portion, and a pin having a distal end;

the outer portion comprising a first, decorative side, a second side opposite the first side;

at least one of the outer portion and the inner portion configured to temporarily secure the distal end of the pin;

(d) pushing the distal end of the pin through the folded portion so that the distal end of the pin extends through the folded portion until it penetrates completely through the folded portion;

(e) attaching the inner portion to the outer portion.

15. The method of claim 14, wherein the pin extends from the second side of the outer portion, and wherein the step of pushing further comprises pushing the distal end of the pin of the outer portion through the folded portion.

16. The method of claim 14, wherein the step of providing at least one temporary hemming element further comprises providing an outer portion that has two pins that extend from the second side.

17. The method of claim 16, wherein each of the pins further comprises a notch and the step of attaching further comprises positioning the pins of the outer portion within a cavity of the inner portion and sliding a clasping device having at least two elongate latches until one of the elongate latches extend through each of the notches corresponding to the pins.

18. The method of claim 16 wherein each of the pins have a groove, and the step of attaching further comprises pressing opposing lateral sides of the inner portion to actuate a lever corresponding to each of the lateral sides to open an aperture corresponding to each of the pins, positioning the pins within the apertures, and releasing the opposing lateral sides.

19. The method of claim 14, wherein the providing step further comprises providing a soft side configured to reside proximate the skin of the wearer of the garment without causing discomfort thereto.

20. The method of claim 14, wherein the providing step further comprises providing a smooth side configured to not snag underlying clothing.

21. The method of claim 14, wherein the garment is a shirt.

22. The method of claim 21, wherein the extending portion is a sleeve of the shirt.

23. The method of claim 21, wherein the extending portion is a bottom edge of the shirt.

24. The method of claim 14, wherein the garment is a pair of pants.

25. The method of claim 14, wherein the garment is a skirt.

26. The method of claim 14, wherein the garment is a dress.

27. The method of claim 14, wherein steps (c)–(e) are repeated for each of the at least one temporary hemming element.

* * * * *